United States Patent [19]

Watanabe et al.

[11] Patent Number: 4,985,176

[45] Date of Patent: Jan. 15, 1991

[54] RESISTIVE PASTE

[75] Inventors: Shizuharu Watanabe, Kyoto; Hiroji Tani, Nagaokakyo; Tohru Kasanami, Tsuzuki, all of Japan

[73] Assignee: Murata Manufacturing Co., Ltd., Japan

[21] Appl. No.: 279,529

[22] Filed: Dec. 2, 1988

[30] Foreign Application Priority Data

Dec. 4, 1987 [JP] Japan ..... 62-307821
Dec. 4, 1987 [JP] Japan ..... 62-307822
Dec. 4, 1987 [JP] Japan ..... 62-307823

[51] Int. Cl.[5] ..... H01B 1/06

[52] U.S. Cl. ..... 252/521; 252/518; 501/17; 501/20; 501/32; 501/65; 501/96; 501/98

[58] Field of Search ..... 252/518, 521; 501/17, 501/20, 96, 98, 32, 65

[56] References Cited

U.S. PATENT DOCUMENTS 4,225,468 9/1980 Donohue et al. ..... 252/521 X
4,420,338 12/1983 Ortega ..... 252/521 X
4,512,927 4/1985 Donohue ..... 252/521
4,585,580 4/1986 Donohue ..... 252/521 X
4,597,897 7/1986 Donohue ..... 252/521 X
4,645,621 2/1987 Nair ..... 252/518 X
4,695,504 9/1987 Watanabe et al. ..... 252/521 X

FOREIGN PATENT DOCUMENTS 2021093 11/1979 United Kingdom .

*Primary Examiner*—Karl Group
*Attorney, Agent, or Firm*—Ostrolenk, Faber, Gerb & Soffen

[57] ABSTRACT

Resistive paste comprises at least one metal hexaboride and a vitreous binder suspended in an organic vehicle, and is characterized in that said vitreous binder is composed of a glass frit consisting essentially of 0.5 to 5.0 mol % of niobium oxide and the balance of alkaline earth metal borosilicate. The resistive paste may further contain at least one nitride selected from the group consisting of aluminum nitride and boron nitride, the content of aluminum nitride or boron nitride in the inorganic solid component composed of metal hexaboride, vitreous binder and aluminum or boron nitride in the paste being 5 to 30 wt %.

12 Claims, No Drawings

RESISTIVE PASTE

FIELD OF THE INVENTION

The present invention relates to resistive paste and, more particularly, to resistive paste for production of thick film circuits consisting of passive elements such as resistors and capacitors deposited on wafers or substrates of such ceramics as alumina and the like.

BACKGROUND OF THE INVENTION

Recently, there is an increasing tendency to employ base metals such as copper, nickel and the like as a material for electrodes or conductor patterns of thick film circuits. Such thick film circuits are generally produced, for example, by respectively printing a conductive pattern of base metal paste and a resistive pattern of resistive paste on substrates, and then firing the same in a non-oxidizing or reducing atmosphere to prevent the conductor patterns from oxidation. It is therefore required to use resistive paste with a high resistance to reduction.

To this end, there have been proposed a variety of resistive pastes generally comprising a conductive material such as metal hexaboride and a nonreducible vitreous binder suspended in an organic vehicle. For example, Japanese patent published No. 59-6481 and Japanese patent laid open Nos. 55-277700 and 55-29199 disclose resistive paste containing lanthanum hexaboride as the conductive material, and a nonreducible glass frit of calcium boroaluminate, barium borosilicate or calcium borosilicate glass as the vitreous binder.

Such a resistive paste can be applied to production of thick film circuits comprising resistors with sheet resistivity ranging from 10 Ω to 10 KΩ. However, such a resistive paste does not provide repeatable results since the sheet resistivity of the resistors produced varies greatly with a slight change of the ratio of glass frit to metal hexaboride. In addition, it is impossible with such resistive pastes to produce thick film resistors with a sheet resistivity of more than 10 KΩ since the sheet resistivity increases abruptly and becomes more than 1 GΩ when the ratio of the glass frit to metal hexaboride exceeds 50 wt% slightly. Further, the thick film resistors with a sheet resistivity of not less than 10 KΩ possess a temperature coefficient of resistance of not less than −1000ppm/° C., thus making impossible to put them into practical use.

SUMMARY OF THE INVENTION

It is therefore an object of the present invention to provide a resistive paste which makes it possible to reproduce thick film resistors with the same resistive values.

Another object of the present invention is to provide a resistive paste which makes it possible to produce thick film resistors with the designed sheet resistivity and a small temperature coefficient of resistance.

Still another object of the present invention is to provide a resistive paste that makes it possible to produce thick film resistors with the resistivity ranging from about 1 Ω to 2.5 MΩ and excellent resistance temperature characteristics even if fired in a reducing atmosphere.

These and other objects of the present invention are solved by providing resistive paste comprising at least one metal hexaboride and a vitreous binder suspended in an organic vehicle, characterized in that said vitreous binder is composed of a glass frit consisting essentially of 0.5 to 5.0 mol% of niobium oxide and the balance of alkaline earth metal borosilicate. The resistive paste according to the present invention may further contain at least one nitride selected from the group consisting of aluminum nitride and boron nitride, of which the content in the inorganic solid component composed of metal hexaboride, vitreous binder and at least one nitride in the paste is 5 to 30 wt%.

According to the present invention, there is provided resistive paste consisting essentially of at least one metal hexaboride and a vitreous binder suspended in an organic vehicle, characterized in that said vitreous binder is composed of a glass frit containing 0.5 to 5.0 mol% of niobium oxide and the balance of at least one alkaline earth metal borosilicate.

According to the present invention, there is further provided resistive paste consisting essentially of at least one metal hexaboride, aluminum nitride and a vitreous binder suspended in an organic vehicle, said vitreous binder being composed of a glass frit consisting essentially of alkaline earth metal borosilicate and 0.5 to 5.0 mol% of niobium oxide, the content of aluminum nitride in the inorganic solid compound composed of metal hexaboride, vitreous binder and aluminum nitride in the paste being 5 to 30 wt%.

According to the present invention, there is also provided resistive paste comprising at least one metal hexaboride, boron nitride and a vitreous binder suspended in an organic vehicle, said vitreous binder being composed of a glass frit consisting essentially of alkaline earth metal borosilicate and 0.5 to 5.0 mol% of niobium oxide, the content of boron nitride in the inorganic solid compound composed of metal hexaboride, vitreous binder and boron nitride in the paste being 5 to 30 wt%.

The metal hexaboride employed as a conductive material includes, without being limited to, hexaborides of alkali metals, alkaline earth metals and rare earth metals. Typical metal hexaborides are, for example, lanthanum hexaboride ($LaB_6$), yttrium hexaboride ($YB_6$), calcium hexaboride ($CaB_6$), barium hexaboride ($BaB_6$), strontium hexaboride ($SrB_6$) and the like.

The alkaline earth metal borosilicate employed as the main component of the glass frit has a composition expressed by the general formula (I) or (II)

$$RO\text{-}B_2O_3\text{-}SiO_2 \quad (I)$$

$$R_2O\text{-}RO\text{-}B_2O_3\text{-}SiO_2 \quad (II)$$

where $R_2O$ is at least one alkali metal oxide such as $Na_2O$ and $K_2O$, and RO is at least one alkaline earth metal oxides such as BaO, CaO, MgO, SrO and the like.

Niobium oxide ($Nb_2O_5$) is incorporated into the alkaline earth metal borosilicate to inhibit an abrupt increase of the sheet resistivity which may occur during firing printed patterns of the resistive paste in a reducing atmosphere. The content of niobium oxide in the glass frit has been limited to from 0.5 to 5.0 mol% for the following reasons. If the content of $Nb_2O_5$ is less than 0.5 mol%, the addition of $Nb_2O_5$ scarcely inhibits increase of the sheet resistivity. If the content of $Nb_2O_5$ exceeds 5 mol%, it segregates from the glass matrix and crystallizes as $Nb_2O_5$, thus making it impossible to obtain the desired effects.

The above glass frit may be mixed with the metal hexaboride in any ratio in accordance with resistive values of thick film resistors to be produced. The greater the weight ratio of glass frit to metal hexaboride, the greater is the resistive value of the thick film resistors deposited on the substrate. However, if the content of glass frit exceeds 95 wt%, it is difficult to obtain the desired resistive values because of the insulating properties of the glass frit. On the other hand, if the content of glass frit is less than 30 wt%, the bonding strength of the inorganic solid components constituting the thick film resistors becomes weak and the adhesion of the thick film resistors to the substrate becomes considerably decreased. It is therefore preferred to incorporate the glass frit into the metal hexaboride so that the content of the glass frit in the inorganic solid component in the resistive paste ranges from 30 wt% to 95 wt% inclusive.

The incorporation of aluminum nitride into the resistive paste contributes to produce thick film resistors with the sheet resistivity ranging from about 10 Ω to 1.2 MΩ without increase of the temperature coefficient of resistance. Further, the incorporation of boron nitride contributes to produce thick film resistors with the sheet resistivity ranging from 2 KΩ to 2.3 MΩ without increase of temperature coefficient of resistance. The reasons why the content of aluminum nitride and/or boron nitride in the inorganic solid component constituting thick film resistors has been respectively limited to values ranging from 5 to 30 wt% are as follows. If the content of aluminum and/or boron nitrides is less than 5 wt %, its effect is scarcely obtained. If the content of aluminum and/or boron- nitrides exceeds 30 wt%, the resistive values of the thick film resistors become considerably increased.

The inorganic solid component in the resistive paste, i.e., glass frit, metal hexaboride and aluminum nitride or boron nitride are suspended in an organic vehicle comprising an organic binder dissolved in an organic solvent.

As the organic binder, there may be used any of the conventionally employed resins. However, the most preferred binders are acrylic resins.

As the organic solvent, there may be used those such as, for example, aliphatic alcohols and esters thereof, terpenes, terpineols, butyl ethylene glycol monomethyl ether, butyl diethylene glycol monomethyl ether acetate, benzyl alcohol and the like. It is preferred to use an organic vehicle consisting essentially of an acryl resin dissolved in α-terpineol. To facilitate hardening or solidification of the resistive paste printed on the substrate, it is preferred to employ a volatile liquid as the solvent.

Since the preferred mixing ratio of the inorganic solid components to the organic vehicle varies with the kind of the organic vehicle used and the process for suspending the solid component in the vehicle, it is impossible to absolutely determine the preferred mixing ratio. However, it is to be noted that the inorganic solid component may be mixed with the organic vehicle in any ratio.

In use, the resistive paste of the present invention is printed in the designed pattern on a substrate of a dielectric material such as alumina and then fired in a reducing atmosphere at temperatures ranging from 600° to 1000° C. After being printed in the designed pattern on the substrate, the conductive paste is fired in the reducing atmosphere to form electrodes or conductive pattern. The conductive pattern may be deposited on the substrate before or after formation of the thick film resistors.

The thus produced thick film resistors are composed of 30 to 95 wt% of the vitreous binder and the balance of metal hexaboride. If aluminum nitride or boron nitride is incorporated into the resistive paste, the thick film resistors are composed of 30 to 95 wt% of vitreous binder, 5 to 30 wt% of aluminum nitride or boron nitride and the balance of metal hexaboride. These thick film resistors have a sheet resistivity ranging from about 1 Ω to 2.4 MΩ, and excellent temperature coefficient of resistance.

EXAMPLE 1

Using $H_3BO_3$, $SiO_2$, $BaCO_3$, $CaCO_3$ and $Nb_2O_5$ as raw materials, there was prepared a glass frit having a composition consisting essentially of 37.00 mol% of $B_2O_3$, 32.50 mol% of $SiO_2$, 18.50 mol% of BaO, 9.50 mol% of CaO and 2.5 mol% of $Nb_2O_5$ in the following manner: The raw materials were weighed, mixed, fused in a platinum crucible, thrown into cold water and finally wet milled with a ball mill.

Commercially available $LaB_6$ powder was milled with a vibration mill and then screened to obtain fine powder of $LaB_6$ having a mean particle size of 5 μm.

The resultant glass frit and $LaB_6$ were mixed with one another in the weight ratios shown in Table 1, mixed with 28 wt% of the organic vehicle consisting essentially of 15 wt% of acryl resin and 85 wt% of αterpineol and then milled with a three roll mill to prepare a resistive paste.

The resultant resistive paste was screen printed on an alumina substrate with baked copper electrodes to form a pattern of resistive paste between respective two electrodes, dried at 120 ° C. for 10 minutes, and then fired in a nitrogen atmosphere at 900 ° C. for 10 minutes.

The sheet resistivity and temperature coefficient of resistance were measured for each thick film resistors. Results are shown in Table 1.

TABLE 1

| Composition (wt %) | | Surface Resistivity (Ω) | T.C.R. (ppm/°C.) | |
|---|---|---|---|---|
| $LaB_6$ | glass frit | | −55° C. | +150° C. |
| 50 | 50 | 60 | 294 | 308 |
| 40 | 60 | 179 | 304 | 316 |
| 30 | 70 | 403 | 342 | 351 |
| 20 | 80 | 824 | 283 | 295 |
| 10 | 90 | 2.2K | 266 | 281 |

From the results shown in Table 1, it is understood that the sheet resistivity of the thick film resistors increases gently with increase of the content of glass frit, but does not exceed 1 GΩeven if the content of glass frit is 90 %. Thus, it is possible with the resistive paste to produce thick film resistors with the designed resistive values by variation of the weight ratio of glass frit to metal hexaboride. The resistive paste have provided repeated results.

EXAMPLE 2

Using the same raw materials used in Example 1, there was prepared a glass frit having a composition consisting essentially of 36.05 mol% of $B_2O_3$, 31.67 mol% of $SiO_2$, 18.02 mol% of BaO, 9.26 mol% of CaO and 5 mol% of $Nb_2O_5$ in the manner disclosed in Example 1.

Using the resultant glass frit, the $LaB_6$ powder and organic vehicle prepared in Example 1, there was prepared resistive paste having weight ratios of glass frit to $LaB_6$ as shown in Table 2, in the same manner as in Example 1.

The resultant resistive paste was screen printed on an alumina substrate with baked copper electrodes to form a pattern of resistive paste between respective two electrodes, dried at 120 ° C. for 10 minutes, and then fired in a nitrogen atmosphere at 900 ° C. for 10 minutes to prepare a thick film circuit comprising thick film resistors.

The thick film circuit was subjected to measurement of sheet resistivity and temperature coefficient of resistance. Results are shown in Table 2.

TABLE 2

| Composition (wt %) | | Surface Resistivity (Ω) | T.C.R. (ppm/°C.) | |
|---|---|---|---|---|
| $LaB_6$ | glass frit | | −55° C. | +150° C. |
| 50 | 50 | 12 | 356 | 362 |
| 40 | 60 | 18 | 404 | 403 |
| 30 | 70 | 27 | 450 | 448 |
| 20 | 80 | 86 | 364 | 372 |
| 10 | 90 | 205 | 347 | 355 |

From the results shown in Table 2, it will be understood that the resistive paste of this example is suitable for use in production of thick film resistors with low resistive values as the sheet resistivity is very small even if the content of glass frit is 90 mol%.

EXAMPLE 3

Using $H_3BO_3$, $SiO_2$, $BaCO_3$, $CaCO_3$, $K_2O$ and $Nb_2O_5$ as raw materials, there was prepared a glass frit having a composition consisting essentially of 35.89 mol% of $B_2O_3$, 31.53 mol% of $SiO_2$, 17.94 mol% of BaO, 9.21 mol% of CaO, 2.43 mol% of $Nb_2O_5$ and 3.00 mol% of $K_2O$ in the same manner as in Example 1.

Using the resultant glass frit, the $LaB_6$ powder and organic vehicle prepared in Example 1, there was prepared resistive paste having weight ratios of glass frit to $LaB_6$ as shown in Table 3, in the same manner as in Example 1.

The resultant resistive paste was screen printed on an alumina substrate with baked copper electrodes to form a pattern of resistive paste between respective two electrodes, dried at 120 ° C. for 10 minutes, and then fired in a nitrogen atmosphere at 900 ° C. for 10 minutes to prepare a thick film circuit comprising thick film resistors.

The thick film circuit was subjected to measurement of sheet resistivity and temperature coefficient of resistance. Results are shown in Table 3.

TABLE 3

| Composition (wt %) | | Surface Resistivity (Ω) | T.C.R. (ppm/°C.) | |
|---|---|---|---|---|
| $LaB_6$ | glass frit | | −55° C. | +150° C. |
| 50 | 50 | 264 | 211 | 229 |
| 40 | 60 | 818 | 284 | 292 |
| 30 | 70 | 1.7K | 318 | 319 |
| 20 | 80 | 5.8K | 264 | 270 |
| 10 | 90 | 11K | 210 | 216 |

As can be seen from the results shown in Table 3, the sheet resistivity of the thick film resistors increases gently with variations in the content of glass frit. Thus, the resistive paste makes it possible to produce thick film resistors with the designed resistive values by suitable selection of the ratio of glass frit to metal hexaboride.

COMPARATIVE EXAMPLE 1

Using $H_3BO_3$, $Al_2O_3$ and $CaCO_3$ as raw materials, there was prepared a glass frit having a composition consisting essentially of 50.0 mol% of $B_2O_3$, 16.7 mol% of $Al_2O_3$ and 33.3 mol% of CaO in the same manner as Example 1.

Using the resultant glass frit, the $LaB_6$ powder and organic vehicle prepared in Example 1, there was prepared resistive paste having weight ratios of glass frit to $LaB_6$ as shown in Table 4, in the same manner as in Example 1.

The resultant resistive paste was screen printed on an alumina substrate with baked copper electrodes to form a pattern of resistive paste between respective two electrodes, dried at 120 ° C. for 10 minutes, and then fired in a nitrogen atmosphere at 900 ° C. for 10 minutes to prepare a thick film circuit comprising thick film resistors.

The thick film circuit was subjected to measurement of sheet resistivity and temperature coefficient of resistance. Results are shown in Table 4.

TABLE 4

| Composition (wt %) | | Surface Resistivity (Ω) | T.C.R. (ppm/°C.) | |
|---|---|---|---|---|
| $LaB_6$ | glass frit | | −55° C. | +150° C. |
| 60 | 40 | 250 | 120 | 210 |
| 50 | 50 | 1.34K | −44 | 29 |
| 40 | 60 | >1G | — | — |

COMPARATIVE EXAMPLE 2

Using $H_3BO_3$, $SiO_2$, $Al_2O_3$, $CaCo_3$, $ZrO_2$ and $TiO_2$ as raw materials, there was prepared a glass frit having a composition consisting essentially of 25.38 mol% of $B_2O_3$, 46.70 mol% of $SiO_2$, 12.69 mol% of $Al_2O_3$, 12.70 mol% of CaO, 2.03 mol% of $ZrO_2$ and 0.507 mol% of $TiO_2$ in the same manner as in Example 1.

The glass frit was then mixed with the $LaB_6$ powder and organic vehicle prepared in Example 1 to prepare resistive paste having weight ratios of glass frit to $LaB_6$ as shown in Table 5, in the same manner as in Example 1.

The resultant resistive paste was screen printed on an alumina substrate with baked copper electrodes to form a pattern of resistive paste between respective two electrodes, dried at 120 ° C. for 10 minutes, and then fired in a nitrogen atmosphere at 900 ° C. for 10 minutes to prepare a thick film circuit comprising thick film resistors.

The thick film circuit was subjected to measurement of sheet resistivity and temperature coefficient of resistance. Results are shown in Table 5.

TABLE 5

| Composition (wt %) | | Surface Resistivity (Ω) | T.C.R. (ppm/°C.) | |
|---|---|---|---|---|
| $LaB_6$ | glass frit | | −55° C. | +150° C. |
| 50 | 50 | 47.7M | −22000 | −3800 |
| 10 | 90 | >1G | — | — |

COMPARATIVE EXAMPLE 3

Using $H_3BO_3$, $SiO_2$, $Al_2O_3$, $CaCO_3$ and $ZrO_2$ as raw materials, there was prepared a glass frit having a composition consisting essentially of 25.00 mol% of $B_2O_3$, 6.10 mol% of $SiO_2$, 12.80 mol% of $Al_2O_3$, 12.50 mol% of CaO and 2.00 mol% of $ZrO_2$, in the same manner as in Example 1.

The resultant glass frit was mixed with the $LaB_6$ powder and organic vehicle prepared in Example 1 and then treated in the same manner as in Example 1 to prepare resistive paste having weight ratios of glass frit to $LaB_6$ as shown in Table 6.

Using the resultant resistive paste, there was prepared a thick film circuit comprising thick film resistors in the same manner as in Example 1.

The thick film circuit was subjected to measurement of sheet resistivity and temperature coefficient of resistance. Results are shown in Table 6.

TABLE 6

| Composition (wt %) | | Surface Resistivity (Ω) | T.C.R. −55° C. | (ppm/°C.) +150° C. |
|---|---|---|---|---|
| $LaB_6$ | glass frit | | | |
| 50 | 50 | 3.32M | −16000 | −3700 |
| 10 | 90 | >1G | — | — |

COMPARATIVE EXAMPLE 4

Using $H_3BO_3$, $SiO_2$, $Al_2O_3$ and BaO as raw materials, there was prepared a glass frit having a composition consisting essentially of 33.00 mol% of $B_2O_3$, 44.80 mol% of $SiO_2$, 6.70 mol% of $Al_2O_3$ and 14.9 mol% of BaO in the same manner as in Example 1.

The resultant glass frit was mixed with the $LaB_6$ powder and organic vehicle prepared in Example 1 and then treated in the same manner as in Example 1 to prepare resistive paste having a weight ratio of glass frit to $LaB_6$ as shown in Table 7.

Using the resultant resistive paste, there was prepared a thick film circuit comprising thick film resistors in the same manner as in Example 1.

The thick film circuit was subjected to measurement of sheet resistivity and temperature coefficient of resistance. Results are shown in Table 7.

TABLE 7

| Composition (wt %) | | Surface Resistivity (Ω) | T.C.R. −55° C. | (ppm/°C.) +150° C. |
|---|---|---|---|---|
| $LaB_6$ | glass frit | | | |
| 50 | 50 | 824K | −21000 | −4300 |
| 10 | 90 | >1G | — | — |

As can be seen from the results shown in Tables 4 to 7, the sheet resistivity of the thick film resistors of the prior art increases abruptly with increase of the content of glass frit and becomes more than 1 GΩ when the content of glass frit is 60%.

EXAMPLE 4

Using $H_3BO_3$, $SiO_2$, $BaCO_3$, $CaCO_3$, $K_2O$ and $Nb_2O_5$ as raw materials, there was prepared a glass frit having a composition consisting essentially of 35.26 mol% of $B_2O_3$, 30.97 mol% of $SiO_2$, 19.39 mol% of BaO, 9.05 mol% of CaO, 2.39 mol% of $Nb_2O_5$ and 2.95 mol% of $K_2O$ in the same manner as in Example 1.

The resultant glass frit was mixed with $LaB_6$ powder having a mean particle size of 0.8 μm and AlN in the weight ratios shown in Table 8. Then, the mixture was suspended in an organic vehicle prepared in Example 1 by milling with a three roll mill to prepare resistive paste consisting essentially of 85 wt% of mixture and 15 wt% of the organic vehicle.

The resultant resistive paste was screen printed in the designed pattern on an alumina substrate with a prefired copper electrodes to form a pattern of resistive paste between respective two electrodes, dried at 120° C. for 10 minutes, and then fired in a nitrogen atmosphere at 900° C. for 10 minutes.

The resultant thick film resistors were subjected to measurement of sheet resistivity and temperature coefficient of resistance. Results are shown in Table 8. In the Table 8, the asterisk shows the thick film resistors prepared from the resistive paste beyond a scope of the present invention.

TABLE 8

| | Composition (wt %) | | | | | |
|---|---|---|---|---|---|---|
| No. | $LaB_6$ | AlN | glass frit | Sheet Resistivity (Ω) | T.C.R. −55° C. | (ppm/°C.) +150° C. |
| 1 | 15 | 5 | 80 | 1.2K | 158 | 175 |
| 2 | 10 | 10 | 80 | 3.8K | 165 | 187 |
| 3 | 20 | 10 | 70 | 7.7K | 122 | 147 |
| 4 | 10 | 20 | 70 | 34K | 84 | 121 |
| 5 | 20 | 20 | 60 | 2.0K | 89 | 116 |
| 6 | 10 | 30 | 60 | 1.2M | −331 | −155 |
| 7 | 15 | 30 | 55 | 251K | 43 | 85 |
| 8 | 60 | 0 | 40 | 26 | 194 | 212 |
| 9 | 20 | 0 | 80 | 225 | 152 | 169 |
| 10* | 10 | 40 | 50 | >1G | measurement | impossible |

From the results shown in Table 8, the thick film resistors containing a certain amount of aluminum nitride possess the sheet resistivity of 1.2 KΩ to 1.2 MΩ and small temperature coefficient of resistance. The thick film resistors with the sheet resistivity of 1.2 MΩ possess the temperature coefficient of −331ppm/° C., thus making it possible to put them into practical use.

EXAMPLE 5

In this embodiment, glass frit and $LaB_6$(mean particle size: 0.8 μm ) both prepared in Example 4 were used as the inorganic solid component for resistive paste together with boron nitride (BN) powder.

The glass frit, $LaB_6$ and BN powder were mixed in the ratios as shown in Table 9, added with the organic vehicle prepared in Example 1, and then milled with a three roll mill to prepare resistive paste consisting essentially of 85 wt% of the inorganic solid component and 15 wt% of the organic vehicle.

The resultant resistive paste was screen printed on an alumina substrate with a prefired copper electrodes to form a pattern of resistive paste between respective two electrodes, dried at 120 ° C. for 10 minutes, and then fired in a nitrogen atmosphere at 900 ° C. for 10 minutes.

The resultant thick film resistors were subjected to measurement of sheet resistivity and temperature coefficient of resistance. Results are shown in Table 9. In Table 9, the asterisk shows the thick film resistors prepared from a resistive paste beyond the scope of the present invention.

TABLE 9

| | Compositon (wt %) | | | | | |
|---|---|---|---|---|---|---|
| No. | $LaB_6$ | BN | glass frit | Sheet Resistivity (Ω) | T.C.R. −55° C. | (ppm/°C.) +150° C. |
| 11 | 15 | 5 | 80 | 2.3K | 155 | 180 |
| 12 | 10 | 10 | 80 | 5.1K | 161 | 192 |
| 13 | 20 | 10 | 70 | 9.6K | 119 | 153 |
| 14 | 10 | 20 | 70 | 55K | 80 | 126 |
| 15 | 20 | 20 | 60 | 4.4K | 85 | 121 |
| 16 | 10 | 30 | 60 | 2.3M | −352 | −148 |
| 17 | 15 | 30 | 55 | 489K | 38 | 92 |
| 18* | 10 | 40 | 50 | >1G | measurement | impossible |

From the results shown in Table 9, it is understood that the thick film resistors containing 5 to 30 wt% of boron nitride possess the sheet resistivity ranging from about 2 KΩ to 2.3 MΩ and small temperature coefficient of resistance of not more than −352 ppm/°C. The content of boron nitride exceeding 30 wt% has resulted in production of insulators.

What is claimed is:

1. A resistive paste consisting essentially of an inorganic solid component suspended in an organic vehicle, said inorganic solid component consisting essentially of at least one metal hexaboride, 5 to 30 weight % of at least one nitride selected from the group consisting of aluminum nitride and boron nitride, and a vitreous binder composed of a glass frit consisting essentially of alkaline earth metal borosilicate and 0.5 to 5.0 mol % of niobium oxide.

2. Resistive paste according to claim 1 containing aluminum nitride and boron nitride.

3. Resistive paste according to claim 1 wherein said metal hexaboride is selected from the group consisting of hexaborides of alkali metals, alkaline earth metals and rare earth metals.

4. Resistive paste according to claim 1 wherein the content of vitreous binder in the inorganic solid component is 30 to 95 wt%.

5. Resistive paste according to claim 1 wherein said nitride is aluminum nitride.

6. Resistive paste according to claim 1 wherein said nitride is boron nitride.

7. Resistive paste according to claim 1 wherein said alkaline earth metal borosilicate is the one having a composition expressed by the general formula (I) or (II)

$$RO\text{-}B_2O_3\text{-}SiO_2 \quad (I)$$

$$R_2O\text{-}RO\text{-}B_2O_3\text{-}SiO_2 \quad (II)$$

where $R_2O$ is at least one alkali metal oxide and RO is at least one alkaline earth metal oxide

8. Resistive paste as claimed in claim 7 wherein $R_2O$ is selected from the group consisting of $Na_2O$ and $K_2O$ and RO is selected from the group consisting of BaO, CaO, MgO and SrO.

9. Resistive paste according to claim 3 in which said hexaboride is $LaB_6$.

10. Resistive paste according to claim 9 wherein the content of vitreous binder in the inorganic solid component is 30 to 95 wt%.

11. Resistive paste according to claim 10 wherein said nitride is aluminum nitride and the content of vitreous binder in the inorganic solid component is 40 to 80 wt%.

12. Resistive paste according to claim 10 wherein said nitride is boron nitride and the content of vitreous binder in the inorganic solid component is 55 to 80 wt%.

* * * * *